United States Patent [19]

Ekkerink

[11] 4,369,535

[45] Jan. 25, 1983

[54] MATTRESS ASSEMBLY

[75] Inventor: Pierre J. Ekkerink, Maastricht, Netherlands

[73] Assignee: Vredestein N.V., Velp, Netherlands

[21] Appl. No.: 218,034

[22] Filed: Dec. 19, 1980

[51] Int. Cl.[3] ..... A47C 27/15; A47C 27/16

[52] U.S. Cl. ..... 5/481; 5/237; 5/460

[58] Field of Search ..... 5/481, 462, 460, 191, 5/236, 237; 297/DIG. 1

[56] References Cited

U.S. PATENT DOCUMENTS

| | | | |
|---|---|---|---|
| 2,468,558 | 4/1949 | Johnson | 5/481 |
| 3,553,745 | 1/1971 | Sproll | 5/236 |
| 3,716,875 | 2/1973 | Feair | 5/481 |
| 4,099,278 | 7/1978 | Parisi | 5/481 |

FOREIGN PATENT DOCUMENTS

| | | | |
|---|---|---|---|
| 2939 | of 1857 | United Kingdom | 5/237 |

*Primary Examiner*—Alexander Grosz
*Attorney, Agent, or Firm*—Diller, Ramik & Wight

[57] ABSTRACT

The invention relates to a mattress assembly comprising an elongated framework, a plurality of parallel laths fastened therein in the direction of width and a mattress consisting at least partly of foam material said mattress assembly being characterized in that the central parts (10) of the laths (8) are located in the mattress and surrounded by foam material and in that the two end parts emerge from the mattress.

13 Claims, 3 Drawing Figures

MATTRESS ASSEMBLY

Figure 1:
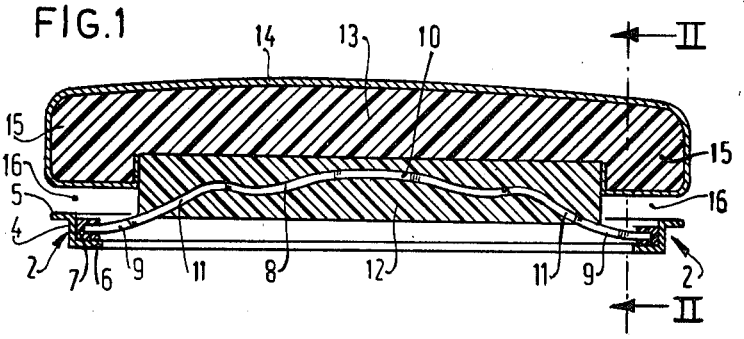

The invention relates to a mattress assembly comprising an elongated framework, a plurality of parallel laths fastened thereto in the direction of width and a mattress consisting at least partly of foam material. Such a mattress assembly usually comprises two separate parts i.e. the framework with the laths and the mattress respectively. Such a known assembly has the disadvantage that the mattress does not lie firmly on the framework and can readily shift in place, particularly when the framework is partly bent upwards. Moreover, many frameworks with laths appear to produce noise when used, whilst bedsteads comprising such a mattress assembly are hardly suitable to sit down on them.

The invention has for its object to obviate these disadvantages and provides a mattress assembly of the kind set forth, which is characterized in that the central parts of the laths are located in the mattress and surrounded by foam material, whereas the end parts on both sides emerge from the mattress. The mattress assembly thus obtained is satisfactorily employed, it has a stable position in a bedstead and is quite suitable as a seat, whilst the laths to be used may be thinner and the production of noise is avoided.

Since the combination of the framework and the laths with the mattress might be a hindrance to "cramming" of blankets it is preferred to leave a free space between the end parts of the laths and the mattress extending up to the side of the mattress assembly for inserting the edges of the blankets into it. In order to firmly retain the edges of the blankets at the correct place it is advisable for the space near the side of the mattress assembly to have a smaller height than the central part of the mattress assembly.

In order to facilitate the manufacture and to simply enlarge the assortment, the central parts of the laths are preferably enclosed in a bottom block of foam material fastened to the bottom side of a horizontally larger upper block of foam material. In this way large numbers of lower blocks can be manufactured, which can subsequently be provided with upper blocks having different covering materials, different degrees of rigidity or different shapes.

By using foam materials of different degrees of rigidity in the lower block and the upper block it is possible, for example, to make a soft support, whilst nevertheless the various laths will not be loaded quite independently, which results in a firm and healthy support.

An easy finish of the upper block and a reliable anchorage of the two parts are obtained when the lower block is partly embedded in the upper block.

In the central part the laths should be completely surrounded by the foam, but at the ends they should protrude to an extent such that a satisfactory support is obtained.

When using known laths having an upwardly cambered central part, whereas the two ends are located substantially horizontally, foam material can be saved, whilst nevertheless the advantages of the curved laths are maintained when the laths have an upward curve on both sides of the central upward curve. In a mechanically advantageous embodiment the top sides of the lateral upward curves are slightly lower than the top sides of the central upward curve.

The invention will be described more fully with reference to the accompanying drawing of a few embodiments thereof.

The drawing shows in

Figure 2:
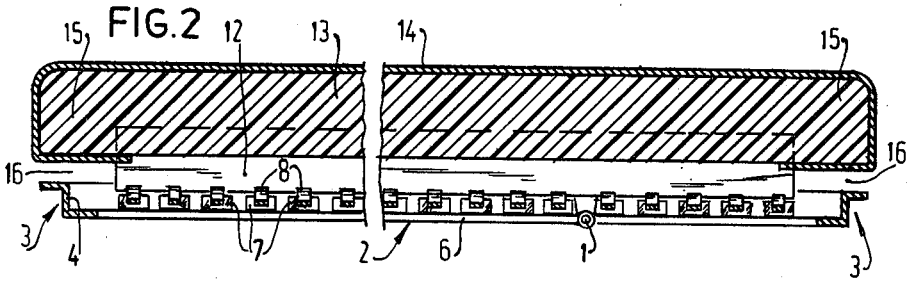
Figure 3:
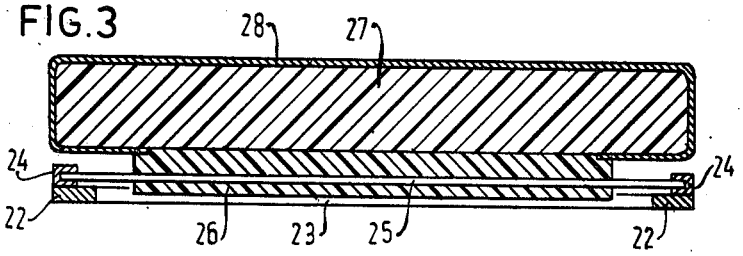

FIG. 1 a vertical sectional view of a mattress assembly in a preferred embodiment, FIG. 2 a vertical, longitudinal sectional view taken on the line II—II in FIG. 1 and FIG. 3 a vertically cross-sectional view like FIG. 1 of a variant of a mattress assembly in accordance with the invention.

The figures show a rectangular framework comprising two length profiles 2 provided with a hinge and at both ends two transverse profiles 3. These profiles have a vertical web 4 having an outer flange 5 at the top and an inner flange 6 on the bottom side. To the inner flanges are fastened curved transverse laths 8 by means of elastic buffers 7. The outer flanges 6 serve to support the mattress assembly in a bedstead.

The laths 8 have horizontal end parts 9 and an upwardly curved central part 10, on both sides of which they have parts 11 curved upwards to a lesser extent. With the exception of the end parts 9 the laths are arranged in a lower block 12 of foam material having a vertically rectangular sectional area, the upper part of said block being received in a correspondingly shaped recess in an upper block 13 of foam material, the outer surface of which is provided with a suitable coating 14.

Preferably, the lower block 12 has a higher degree of rigidity than the upper block 13. The dimensions of the upper block 13 are such that this block just extends on all sides beyond the framework.

Between the end parts 9 of the laths connected with the longitudinal profiles 2 and the peripheral part 15 of the upper block 13 is left a space 16 for cramming blankets. Near the side of the mattress assembly between the side edge of the upper block 13 and the upper edge of the framework said space 16 has a smaller height than further to the center of the mattress assembly. As a result a considerable part of a blanket can be crammed in and firmly clamped without any appreciable deformation of the mattress. From FIG. 2 it will be apparent that even on the narrow sides of the mattress assembly a corresponding space 16 may be provided.

From FIG. 1 it will be apparent that the coating 14 can be quite readily finished between the two blocks. Obviously matresses forming single units may be provided in the manner described above as well with laths embedded therein.

FIG. 3 shows in a cross-sectional view a different embodiment of a mattress assembly. A rectangular-section framework of longitudinal and transverse wooden laths 22 and 23 respectively has fastened to it straight laths 25 of stratified wood with the aid of blocks 24 of rubber-elastic material. Apart from the two ends each lath 25 is embedded in a block 26 of foam material, which is fastened to the bottom of a broader block 27 of foam material. With the exception of the part covered by the small block 26 the latter block 27 having rounded-off corners on the top side is surrounded by textile coating 28.

I claim:

1. A mattress assembly comprising an elongated framework, a plurality of parallel laths fastened therein in the direction of width and a mattress consisting at least partly of foam material, characterized in that the central parts of the laths are located in the and surrounded by the foam material and in that the two end parts emerge from the mattress.

2. A mattress assembly as claimed in claim 1, characterized in that a free space (16) extending up to the side of the mattress assembly is left between the end parts (9) of the laths (8) and the part of the mattress located above said parts.

3. A mattress assembly as claimed in claim 1 or 2, characterized in that the central parts of the laths are enclosed in a lower block of foam material fastened to the bottom side of an upper block of foam material, which is larger in a horizontal sense.

4. A mattress assembly as claimed in claim 3, characterized in that the lower block is partly embedded in the upper block.

5. A mattress assembly as claimed in claim 3, characterized in that the material of the lower block has a degree of rigidity differing from that of the upper block.

6. A mattress assembly as claimed in claims 1 or 2 in which said laths have central parts which are upwardly curved, whereas the two ends are located substantially horizontally and on both sides of the central upward curve the laths have an upward curve.

7. A mattress assembly as claimed in claim 6 characterized in that the top sides of the lateral upwards curves are slightly lower than the central upward curve.

8. A mattress assembly comprising an open, rectangular framework presenting spaced, longitudinally extending side frame members interconnected at their opposite ends by end frame members; a mattress comprising a lower portion formed of foam material and having a plan view profile which is smaller than the space enclosed by said frame members, said mattress also including an upper portion which peripherally overlies said framework and is spaced above at least said side frame members; and a plurality of laths having their opposite ends resting on said side frame members and having central portions embedded within said foam material of the lower portion of the mattress to present opposite end portions which project from said lower portion to underlie the periphery of said upper portion of the mattress in spaced relation thereto.

9. A mattress assembly as defined in claim 8 wherein said upper portion is provided with an undersurface recess fixedly receiving said lower portion.

10. A mattress assembly as defined in claim 8 or 9 wherein the central portions of said laths are upwardly arched.

11. A mattress assembly as defined in claim 10 wherein each lath is provided to each side of its central portion with a secondary upward arch, all of the arches of each lath being embedded in the foam material of said lower portion of the mattress.

12. A mattress assembly as defined in claim 11 wherein the upper portion of the mattress is also formed of foamed material in which the foamed material of said lower portion is more rigid than that of the upper portion.

13. A mattress assembly as defined in claim 8 or 9 wherein the upper portion of the mattress is also formed of foamed material in which the foamed material of said lower portion is more rigid than that of the upper portion.

* * * * *

UNITED STATES PATENT AND TRADEMARK OFFICE

CERTIFICATE OF CORRECTION

PATENT NO. : 4,369,535

DATED : January 25, 1983

INVENTOR(S) : Pierre J. Ekkerink

It is certified that error appears in the above-identified patent and that said Letters Patent is hereby corrected as shown below:

On the title page Insert:

[30] Foreign Application Priority Data

Netherlands application no. 7909210 filed December 20, 1979

Signed and Sealed this

*Twenty-ninth* Day of *March 1983*

[SEAL]

*Attest:*

GERALD J. MOSSINGHOFF

*Attesting Officer*

*Commissioner of Patents and Trademarks*